United States Patent [19]

Cerrato

[11] Patent Number: 4,516,698

[45] Date of Patent: May 14, 1985

[54] KEG-PUMP CONSTRUCTION

[75] Inventor: Vincent J. Cerrato, Camarillo, Calif.

[73] Assignee: Vending Components, Inc., Hackensack, N.J.

[21] Appl. No.: 463,135

[22] Filed: Feb. 2, 1983

[51] Int. Cl.[3] ..... B67D 5/42

[52] U.S. Cl. ..... 222/341; 222/400.7

[58] Field of Search ..... 222/400.7, 383, 384, 222/400.8, 341, 340; 137/212; 417/511

[56] References Cited

U.S. PATENT DOCUMENTS 4,341,240 7/1982 Cerrato ..... 222/400.7

4,350,273 9/1982 Nezworski et al. ..... 222/400.7

*Primary Examiner*—Stanley H. Tollberg

*Attorney, Agent, or Firm*—Hopgood, Calimafde, Kalil, Blaustein & Judlowe

[57] ABSTRACT

A keg-tapping device wherein a probe is selectively actuable within a tap body, between axial positions of communication with and cut-off from the inner volume of the keg, to which it may be attached. The probe extends upwardly beyond the tap body and carries an axially reciprocable air pump at its upper end, while a beverage-dispensing port is open laterally, at a location beneath the pump and above the tap body. A pressure-relief valve with external actuating access is carried by the probe, and the arrangement is such that the probe and all components mounted thereto are bodily rotatable, over a full 360 degrees of lateral-discharge direction for beverage delivered at the discharge port. Conveniently, a flexible hose connects the discharge port to a selectively operable dispensing valve, and the dispensing valve is therefore flexibly adaptable, without keg movement, to serve glasses within a maximum radius (hose length), whatever the azimuth direction at which a glass is to be served.

8 Claims, 3 Drawing Figures

KEG-PUMP CONSTRUCTION

BACKGROUND OF THE INVENTION

The invention relates to keg-tapping devices and in particular to such a device which incorporates its own manually operated air pump, for pressurized delivery of beverage from the keg to which it is fitted.

Manually pumped pressurized air is the convenient means of delivering beer or other beverage from a small keg, as may be readily portable to serve the needs of a picnic, where pressurized gas is otherwise not available. The convenient way in which to manually derive the pressurized air is via vertically downward reciprocation, against the action of a return spring. The pump and its action dominate the vertical axis of the tap, and delivered beverage must be dispensed radially outward from the tap. Such devices have provided for such outward discharge at a fixed angular location, but this is awkward for beverage dispensing to a small group of persons, at different locations around the keg, necessitating frequent movement of the keg.

BRIEF STATEMENT OF THE INVENTION

It is an object of the invention to provide an improved keg-tap and pump construction of the character indicated.

A specific object is to provide such a constuction wherein the means of beverage discharge is freely rotatable about the vertical axis of the tap, so that it becomes convenient to swing the point of discharge around this axis and thus avoid any need to readjust the position of the keg.

A general object is to meet the above objects with structure of basic simplicity, inherent reliability and low cost, and ready serviceability.

The invention achieves the foregoing objects in a keg-tapping device wherein a probe is selectively actuable within a tap body, between axial positions of communication with and cut-off from the inner volume of the keg to which it may be attached. The probe extends upwardly beyond the tap body and carries an axially reciprocable air pump at its upper end, while a beverage-dispensing port is open laterally, at a location beneath the pump and above the tap body. A pressure-relief valve with external actuating access is carried by the probe, and the arrangement is such that the probe and all components mounted thereto are bodily rotatable, over a full 360 degrees of lateral-discharge direction for beverage delivered at the discharge port. Conveniently, a flexible hose connects the discharge port to a selectively operable dispensing valve, and therefore flexibly adaptable, without keg movement, to serve glasses within a maximum radius (hose length), whatever the azimuth direction at which a glass is to be served.

DETAILED DESCRIPTION OF A PREFERRED EMBODIMENT

The invention will be illustratively described in conjunction with the accompanying drawings, in which.

Figure 1:
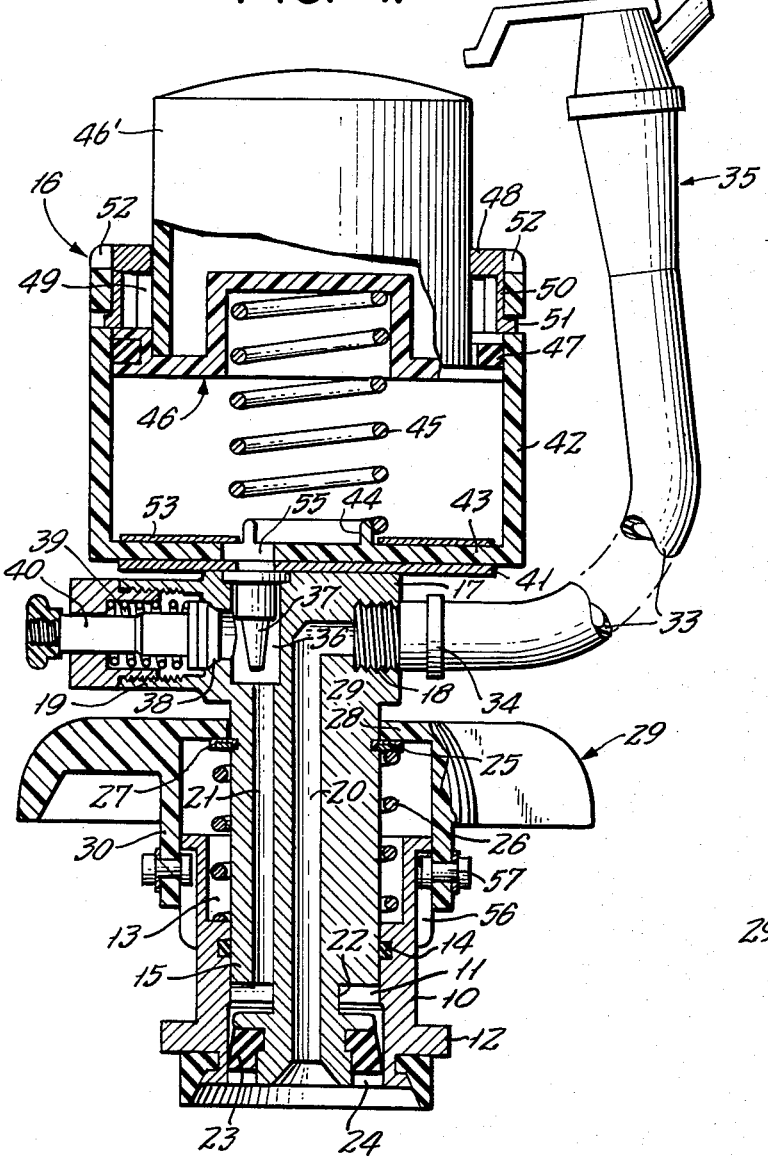
FIG. 1 is a vertical sectional view through keg-tapping structure of the invention.

In the drawings, a tap of the invention comprises an angular body 10 having an upstanding cylindrical bore 11 which extends from a keg-adaptable locking flange 12 to an upwardly open counterbore 13 at its upper end. Within the bore 11, a circumferential groove retains an elastomeric O-ring 14 by which the cylindrical body of a probe 15 derives peripherally sealed guidance, for both axial and rotary displacement in bore 11.

Probe 15 extends above the upper end of body 10 to carry manually operable air-pump structure 16 at its upper end. A generally rectangular head 17 is an integral upper end part of the probe body, providing a mounting platform for pump 16 and opposed lateral porting, at 18 for beverage-dispensing, and at 19 for pressure-relief venting. The beverage-dispensing port 18 is served by a first probe passage 20 which is open to the center of the lower end of probe 15; and the pressure-relief port 19 is served by a second passage 21 which is open to a peripheral groove 22 near the lower end of probe 15 and at offset from the lower end of passage 20. A probe washer 23 carried by the lower end of probe 15 has yieldable contact with a lower-end counterbore 24 in body 10, to isolate the lower ends of passages 20–21 from each other and to avoid discharge of beverage via passage 21.

Shoulder means, in the form of a snap ring 25 retained in a peripheral groove of probe 15, is located between the port formations 18–19 and the upper end of body 10. This shoulder means provides multiple functions of the entire structure. First, it establishes an upper-end contact for a compression spring 26 which is seated at the bottom of body counterbore 13. Second, in conjunction with a circumferentially continuous flanged annular cup 27, it provides smooth continuous rotary-bearing support beneath the inward flange 28 of a rotary handle 29. Handle 29 integrally includes a depending sleeve or hub portion 30 having axial overlap with the upper end of body 10; and within this region of axial overlap, hub 30 and body 10 have coacting cam and follower formations whereby handle rotation (from the uppermost position shown in FIG. 1) drives handle 29 downward in further compression of spring 26 and with concurrent downward displacement of probe 15. In the down position of probe 15, the probe washer 23 will be understood to clear the lower end of counterbore 24, thus exposing air passage 21 to the upper volume of a keg, and the lower end of the probe will be understood to have gained access for passage 20 to the central draft tube (not shown) of the tapped keg. Reverse relative rotation of handle 29 with respect to body 10 results in return of the parts to the relation shown in FIG. 1, and, regardless of whether handle 29 is operated to advance or retract probe 15, the probe with all its appurtenances is free to rotate about the probe axis.

The discharge port 18 is shown with a fitting for accommodation of a flexible hose 33, clamped by means 34 and extending to remote-end dispensing-valve or faucet structure 35.

An enlarged upper end or chamber 36 of passage 21 accepts mounting of a check valve 37, which may be of simple elastomeric "duck bill" construction, to limit air flow from pump 16, for flow only in the down direction. Chamber 36 provides port 19 with access to the downstream side of check valve 37, and a relief-valve member 38 is spring-loaded by means 39 to its normally seated position in port 19. Member 38 will lift to vent the tapped keg in the event of pressure development in excess of a predetermined level; and a stem connection 40 to valve member 38 is externally accessible to enable selective manually operated venting of keg pressure.

It has already been indicated that the flat upper surface of the probe head 17 establishes a mounting platform for the air pump 16. This flat surface is locally counterbored at the upper end of chamber 36 for compressed retention of the mounting flange of check valve 37, compression being applied when a lower circular mounting plate 41 of the pump is secured to probe head 17, as will become clear.

In the form shown, the air pump 16 comprises an upwardly open cup-shaped cylinder member having a cylinder wall 42 and a bottom-closure wall 43, with an integrally formed short upward locating central flange 44 for nested location of a spring 45. A piston member 46 is centrally cupped for nested location of the upper end of spring 45, and an elastomeric ring 47 seals piston member 46 to wall 42 in its reciprocation cycle. An inverted cup-shaped stem 46' is permanently assembled to and therefore a part of piston member 46, projecting upwardly above the cylinder wall 42 and having a slightly crowned upper surface, for comfortable palmed operation of the pump. An inverted cup-shaped annular tail member 48 includes a skirt 49 with integral snap-lug formations 50 for engagement in local apertures 51 at short offset from the upper end of cylinder wall 42. Skirt 49 will be seen to establish an abutment against further spring-urged upward displacement of piston member 46, and arcuate retaining flanges 52 limit the axial insertion of tail member 48 into cylinder wall 42.

Figure 3:
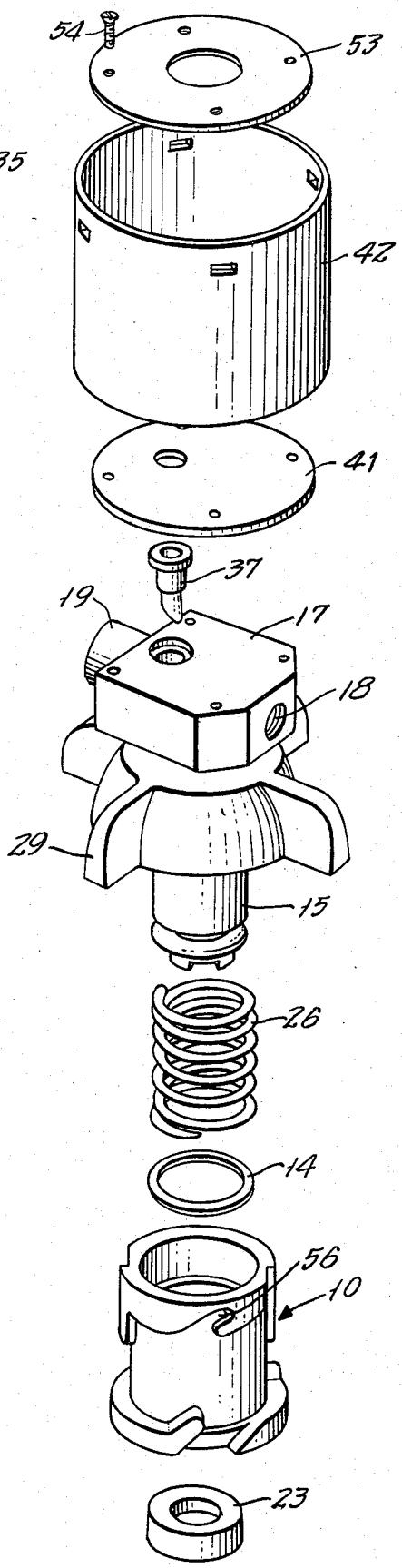
FIG. 3 is a simplified exploded view in perspective of certain of the parts of FIG. 1.
Figure 2:
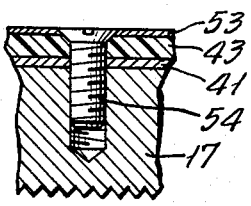
FIG. 2 is an enlarged fragmentary vertical sectional view through connected parts of FIG. 1, the section plane being at an angle offset from that of the section of FIG. 1.

An annular metal plate 53 of substantially bottom wall (43) extent locates on flange 44 and provides non-fretting base support for spring 45. As seen in FIGS. 2 and 3, plate 53, bottom wall 43, and plate 41 have plural apertures aligned for bolts 54 to tapped holes in the probe head 17 whereby fully reinforced and rigid mounting is afforded the cylinder of the air pump, through clamping action of bolts 54; plates 41 and 53 are preferably of stainless steel, suitably about 16 ga.; for a cylinder diameter of about 6 cm. In the bolted postion, further apertures (at 55) in plates 53–41 and bottom wall 43 align for compressed-air delivery to the upstream side of check valve 37.

The described structure will be seen to achieve all stated objects, being of simple, inexpensive construction, and facilitating full 360-degree rotatability of probe 15 and its associated beverage-dispensing means 33–35. The displacement efficacy of the air pump enables beverage to be dispensed after as few as six cycles of pump reciprocation. If foaming occurs, through excessive pumping or otherwise, a simple manipulation at relief valve stem will vent pressure from the keg. With the principal exception of metal parts (e.g., body 10, probe 15, plates 41–53, and springs 26–45), the operative parts 29, 42 (43), 46 (46') lend themselves to injection-molding of suitable commercially available plastic materials. And at the rotary-cam engagement between the hub 30 of handle 29 and the upper end of body 10, it is desirable to provide cam surfaces 56 as integral formations of metal body 10, along with the notched characterizations of base flange 12, for the customary beerkeg bayonet engagement. This being the case, followers of cam surfaces 56 are shown as suitably headed pins 57, in riveted assembly to the hub sleeve 30 of handle 29. The metal of body 10 may be cast steel.

While the invention has been described in detail for a preferred embodiment, it will be understood that modifications may be made without departing from the scope of the invention.

What is claimed is:

1. A keg-pump assembly for removable attachment to a keg for pressurized delivery of beer or other beverage within the keg, comprising a generally annular body having a keg-engageable flanged lower end and a cylindrical bore extending upwardly from said lower end, an elongate probe having a cylindrical lower portion in longitudinally and rotatably displaceable sealed relation to said bore and extending upward beyond the upper end of said body, said probe having a first internal passage communicating between the lower end of the probe and an outwardly directed beverage-dispensing port at a location above said body, said probe having a second internal passage communicating between the upper end of the probe and open at the lower end of the probe at a location offset from the lower end of the first passage, reciprocable manual air-pump means carried by the upper end of said probe for directional delivery of pressurized air down the second passage, radially outward shoulder means on said probe at a location between said beverage-dispensing port and the upper end of said body, compressionally loaded spring means reacting between said body and said shoulder means to urge said probe upwardly with respect to said body, and a handle including an annular hub circumferentially encompassing and rotatably engaged to said shoulder means and in axial overlap with the upper end of said body, said body and handle having in their region of overlap coacting cam and follower formations determining axial compression of said spring in the course of relative rotation of said handle and body from a fixedly limited upper position of said handle to a lower handle position of greatest spring compression and of maximum downward displacement of the lower end of said probe beyond the lower end of said body.

2. The assembly of claim 1, in which said second passage includes a check valve oriented to assure only downward flow of pressurized air.

3. The assembly of claim 1, in which said air-pump means comprises an upwardly open cup-shaped cylinder member secured at its closed lower end to said probe and having an outlet port communicating with said second passage when thus secured, a piston member having axially displaceable peripherally sealed engagement within said cylinder member, an upwardly projecting stem connected to said piston member, an annular tail member connected to the upper end of said cylinder member and having a central opening in guiding relation to said stem, and spring means within said cylinder and preloaded against said piston member to normally urge the same to an upper position of limiting abutment with said tail member.

4. The assembly of claim 2, in which said probe includes a radially outward port passage communicating with said second passage at a location downstream from the location of check-valve discharge, and relief-valve means in said port passage.

5. The assembly of claim 1, in which said air-pump means includes an upwardly open cup-shaped cylinder member of injection-molded plastic construction and having a flat lower end-closure wall, first and second flat metal reinforcing plates in lapped adjacency with upper and lower surfaces of said wall and substantially coextensive therewith, and threaded means rigidly securing said plates and lower wall in compression against the upper end of said probe.

6. The assembly of claim 1, and dispensing means including a flexible-hose connected at one end to said discharge port and including a selectively operable dispensing valve at its other end.

7. The assembly of claim 4, in which said relief-valve means includes externally accessible means for selectively operating the same for venting purposes.

8. The assembly of claim 1, in which said shoulder means comprises a circumferential snap ring that is groove-retained by said probe.

* * * * *

Disclaimer and Dedication 4,516,698.—*Vincent J. Cerrato,* Camarillo, Calif. KEG-PUMP CONSTRUCTION. Patent dated May 14, 1985. Disclaimer and Dedication filed June 21, 1985, by the assignee, *Vending Components, Inc.*

Hereby disclaims and dedicates to the Public the entire term of said patent.

[*Official Gazette August 27, 1985.*]